US007402117B2

(12) United States Patent
Wang

(10) Patent No.: US 7,402,117 B2
(45) Date of Patent: Jul. 22, 2008

(54) RACKET WITH A CENTER OF GRAVITY APPROXIMATE TO A CENTER OF A RUBBER SHEET

(76) Inventor: Kai-Ping Wang, P.O. Box 26-757, Taipei 106 (TW)

( * ) Notice: Subject to any disclaimer, the term of this patent is extended or adjusted under 35 U.S.C. 154(b) by 288 days.

(21) Appl. No.: 10/913,545

(22) Filed: Aug. 9, 2004

(65) Prior Publication Data

US 2006/0030436 A1 Feb. 9, 2006

(51) Int. Cl.
*A63B 59/04* (2006.01)

(52) U.S. Cl. ..... 473/527; 473/537

(58) Field of Classification Search ..... 473/527–530, 473/524

See application file for complete search history.

(56) References Cited

U.S. PATENT DOCUMENTS 293,573 A * 2/1884 Greenough et al. ..... 473/524
2,122,901 A * 7/1938 Urbanek ..... 416/70 R
D226,206 S * 1/1973 Rankin, Jr. et al. ..... D21/731
D344,314 S * 2/1994 Malkoun ..... D21/731
5,312,101 A * 5/1994 McDaniel ..... 473/526
5,961,404 A * 10/1999 Gormley ..... 473/530
6,461,259 B1 * 10/2002 Li ..... 473/527

FOREIGN PATENT DOCUMENTS

DE 3612992 A1 * 10/1987
FR 2811582 A1 * 1/2002
WO WO97/25110 * 7/1997

* cited by examiner

*Primary Examiner*—Raleigh W. Chiu
(74) *Attorney, Agent, or Firm*—Troxell Law Office, PLLC

(57) ABSTRACT

A racket is described, with a center of gravity thereof being approximate to a center of a rubber sheet of the racket, and a center of gravity that moves approximately to the center of rubber sheet and is located in a high ball-strike area. The racket has a substantially triangular blade. The blade comprises a head, a neck and a handle. The head becomes gradually narrower from front to back of the head, and the handle can further be lightened. The center of gravity of the racket can thereby move forward to the center of the rubber sheet to enhance attack and defense abilities of the racket, and reduce shock.

7 Claims, 9 Drawing Sheets

RACKET WITH A CENTER OF GRAVITY APPROXIMATE TO A CENTER OF A RUBBER SHEET

BACKGROUND OF THE INVENTION

1. Field of the Invention

The present invention relates to a racket with a center of gravity thereof approximate to a center of a rubber sheet of the racket, and especially to a racket whose center of gravity moves approximately to the center of rubber sheet and is located in a high ball-strike area, thereby enhancing attack and defense abilities of the racket, and reducing shock.

2. Description of Related Art

FIGS. 1–4 illustrate a conventional racket. A head 12, 22 of the racket is substantially square-shaped (racket 1), or is substantially circular-shaped (racket 2). The rackets 1, 2 comprise blades 11, 22 and rubber sheets 14, 24. The blades 11, 21 comprise heads 12, 22, necks 102, 202 and handles 13, 23. The rubber sheets 14, 24 are attached on the heads 12, 22. A connecting line connecting two outermost points of the heads 12, 22 (line connecting two respective outermost points of two sides of the head) is positioned substantially in a front end of a rear half portion of the heads 12, 22. The centers of gravity 101, 201 are positioned in a place substantially adjacent to rear ends of the rubber sheets.

Almost all of the strike points are located in the front end and the middle of the heads 12, 22 (that is, the high ball-strike area is in the two front L/3), and the balls struck in the two portions are far from the centers of gravity 101, 201. Thus, from a physics point of view, the rackets 1, 2 generate relatively bigger rotational forces. Bigger rotational forces cause the greater shocks, and greater force is required to strike the balls. Hitting a high-energy ball is thus difficult, and may even lack a better ball hit feel and interest.

Therefore, how to make the centers of gravity 101, 201 move into the high ball-strike area (for example, making the centers of gravity approximate to the center 141 of the rubber sheet) is a desired object of the present invention.

SUMMARY OF THE INVENTION

An object of the present invention is to provide a racket with a center of gravity approximate to a center of a rubber sheet, in which the center of gravity approaches the center of the rubber availably. In other works, the center of gravity of the racket is moved into a high ball-strike area, thereby hitting more high-energy balls to improve attack, decreasing a chance of losing a ball to a firm defense, and reducing shock to get a better striking feel.

To achieve the above object, a racket with a center of gravity approximate to a center of a rubber sheet is provided. The racket has a blade comprising a head. The head becomes gradually narrower from front to back, and a line connecting two outermost points of the head is positioned in a front half portion of the head.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

BRIEF DESCRIPTION OF THE DRAWINGS

The foregoing aspects any many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
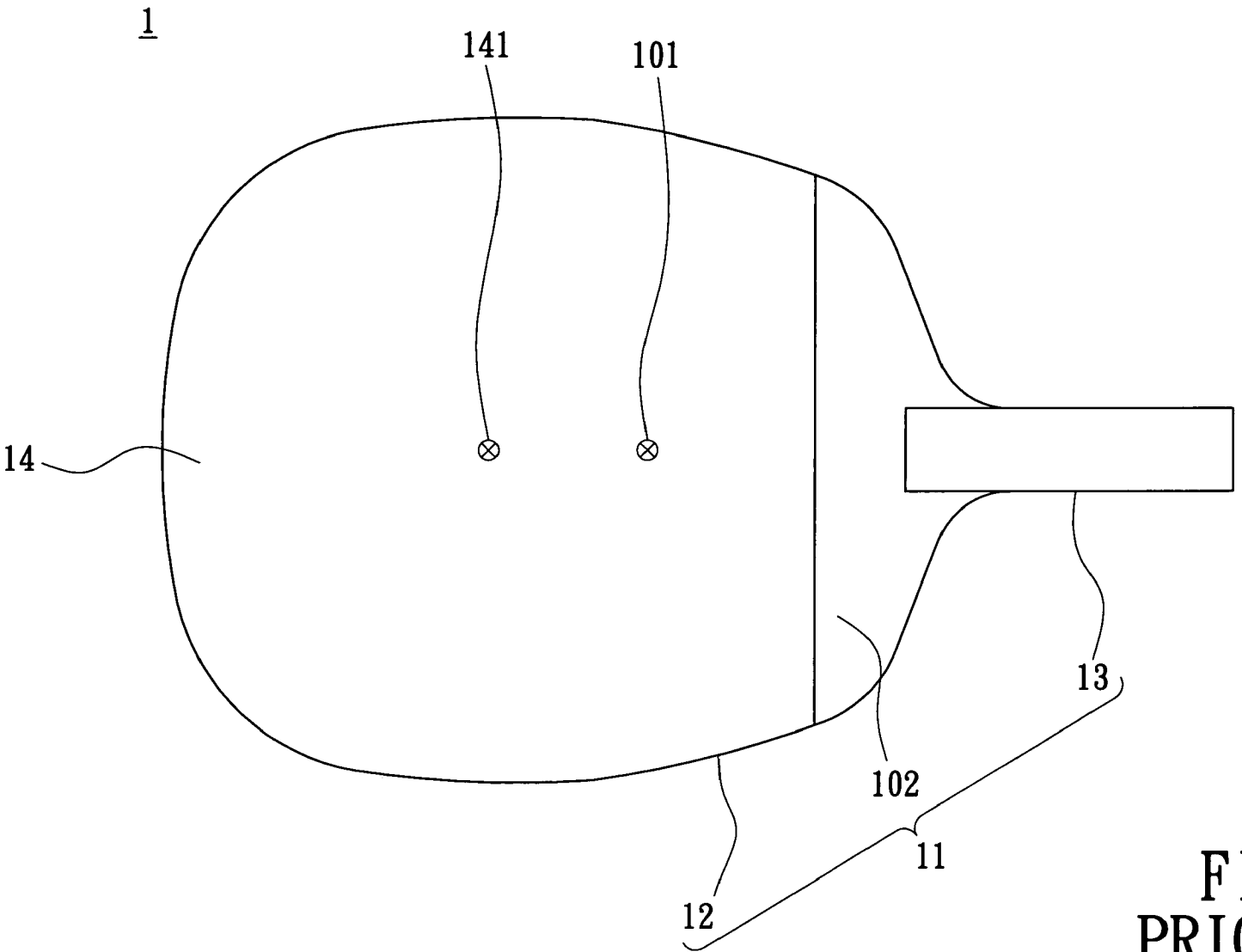
FIG. 1 PRIOR ART
FIG. 1 is a front view of a conventional square racket.
Figure 2:
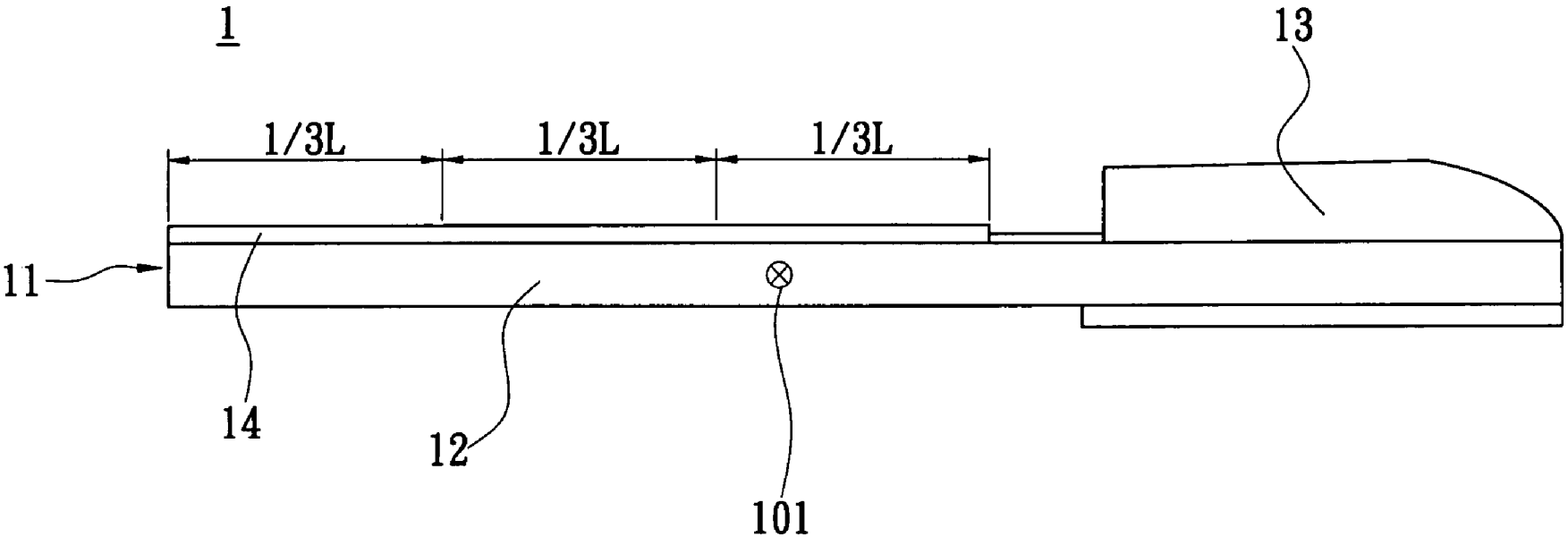
FIG. 2 PRIOR ART
FIG. 2 is a side view of the conventional square racket in FIG. 1.
Figure 3:
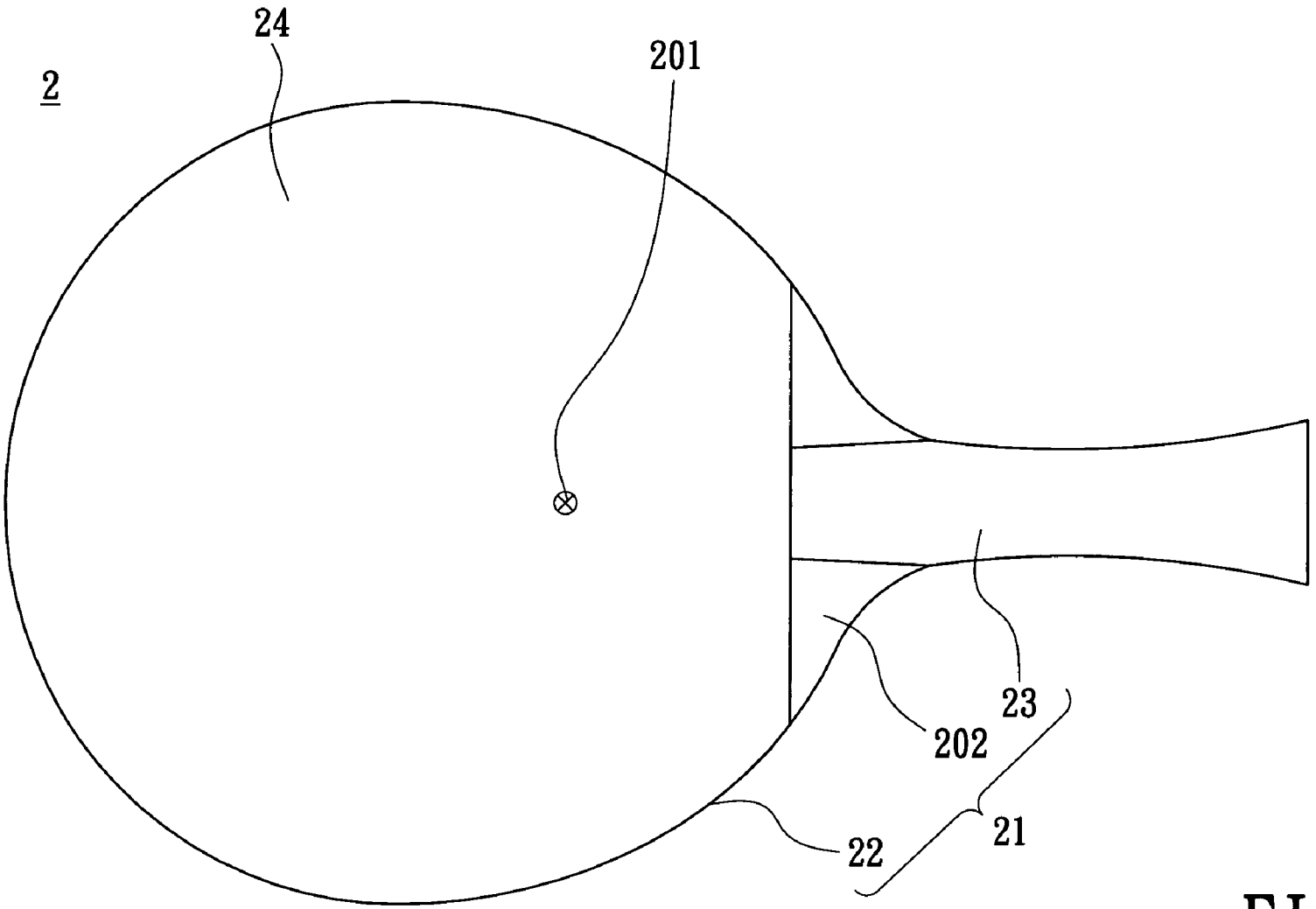
FIG. 3 PRIOR ART
FIG. 3 is a front view of a conventional circular racket.
Figure 4:
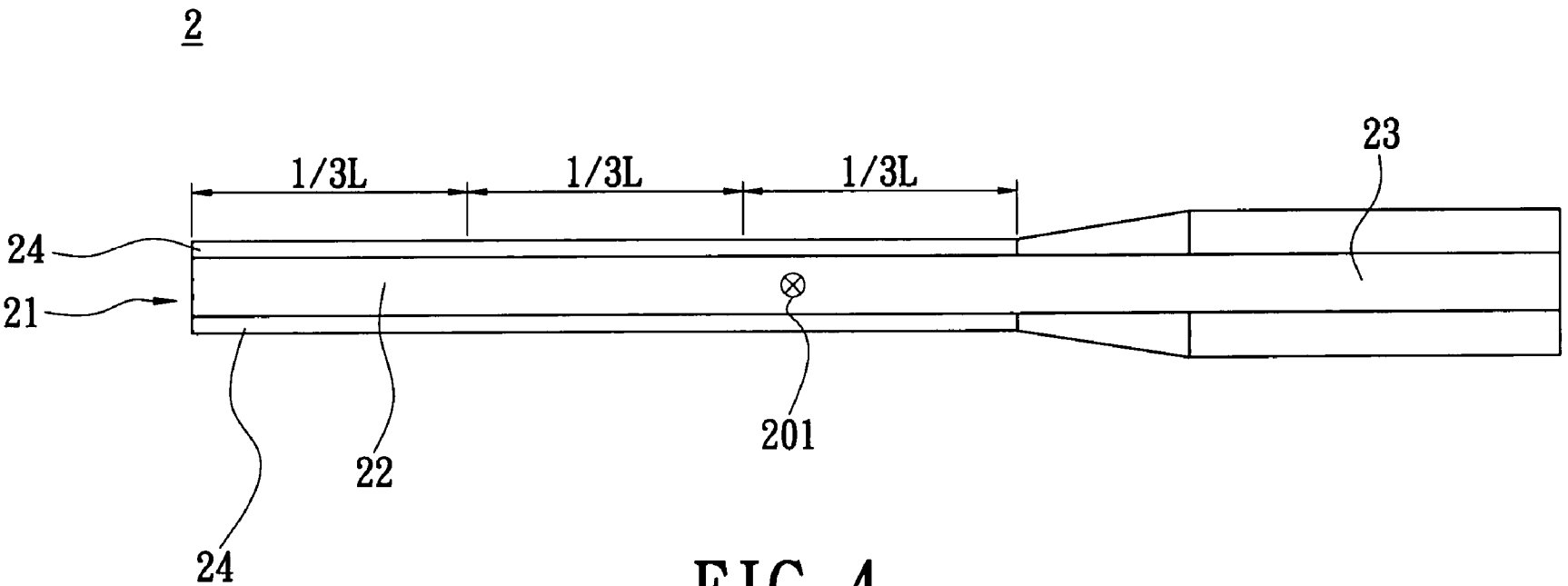
FIG. 4 PRIOR ART
FIG. 4 is a side view of the conventional circular racket in FIG. 3.
Figure 5:
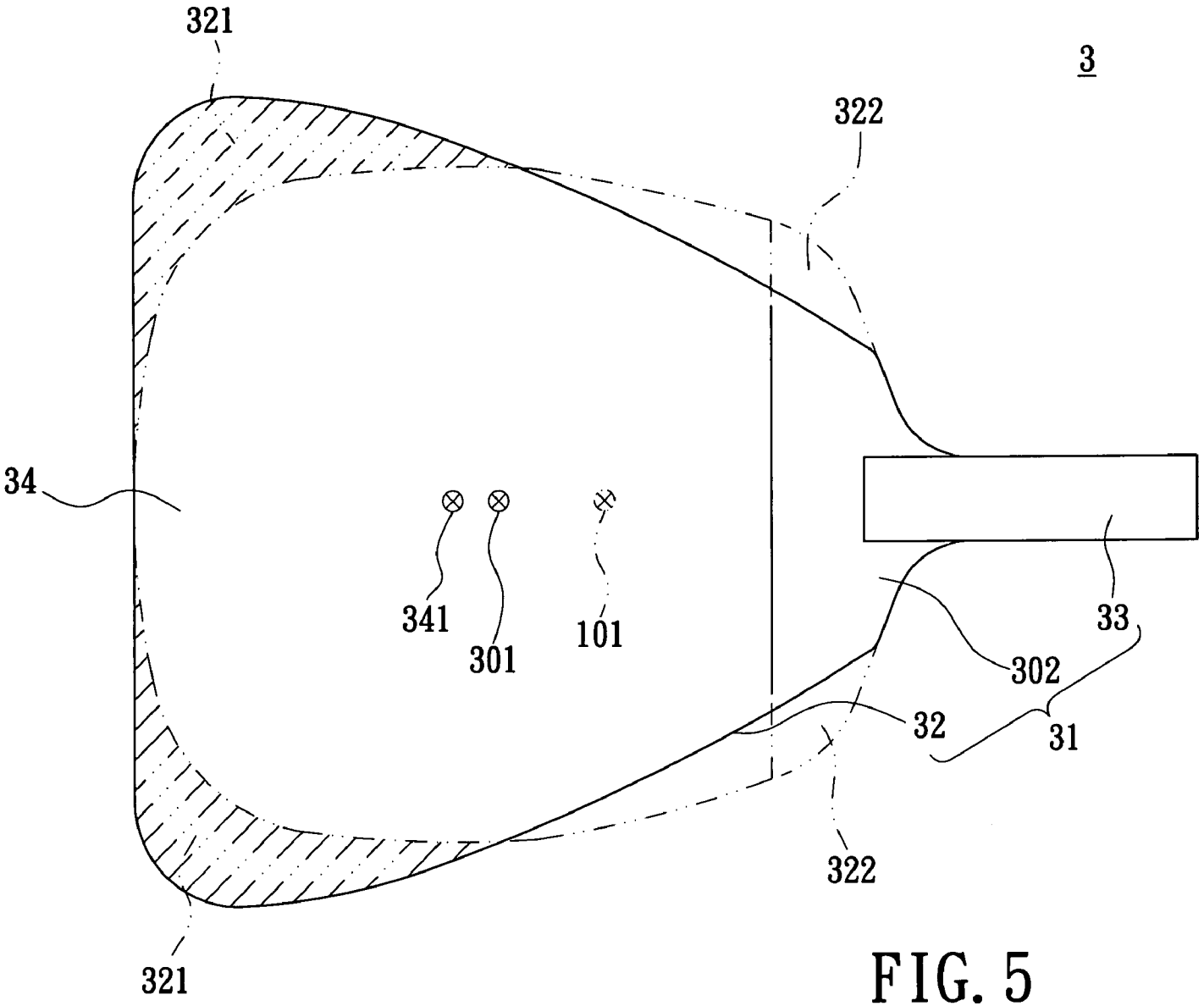
FIG. 5 is a front view of a first racket of the present invention compared to the conventional square racket.
Figure 6:
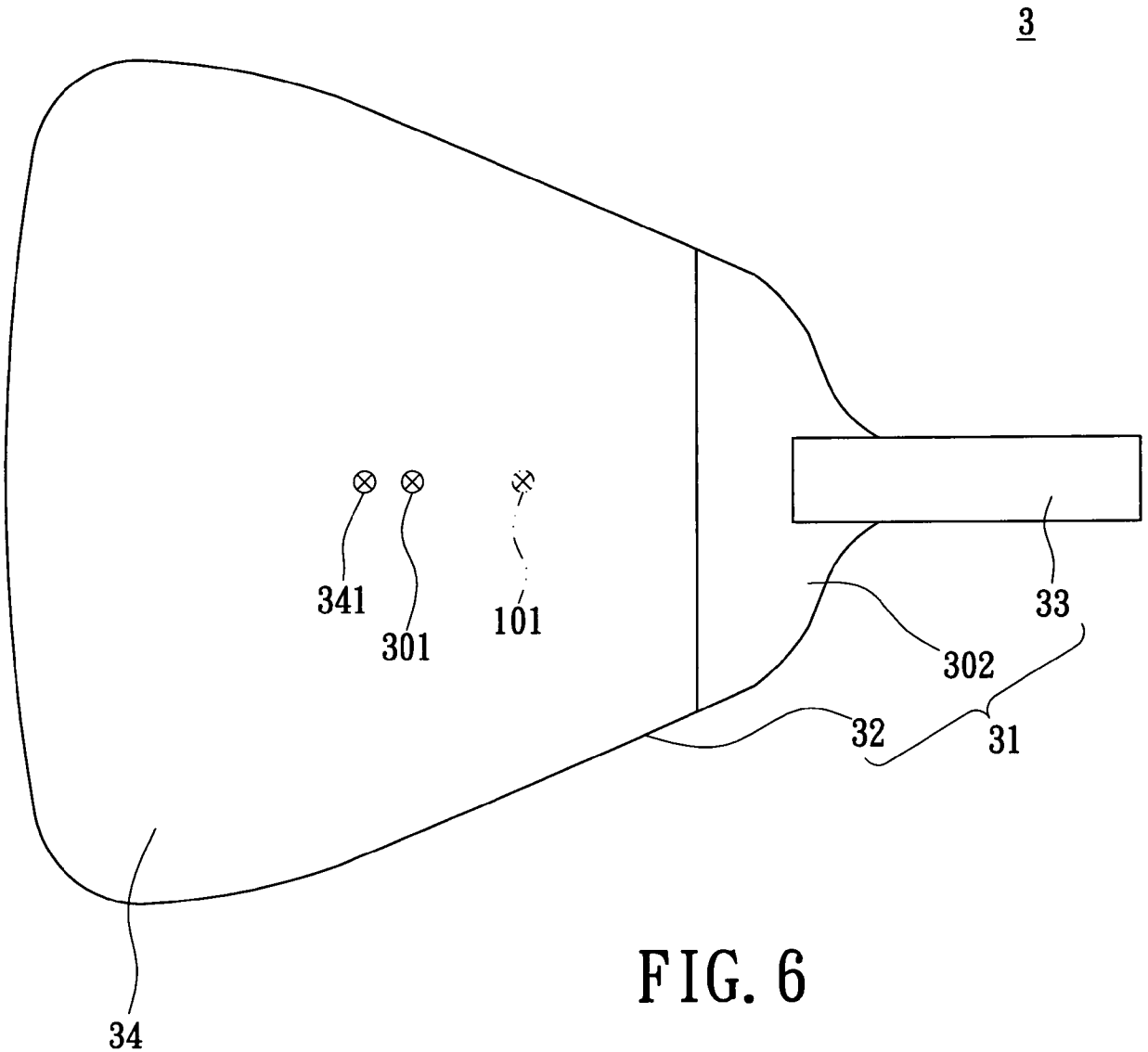
FIG. 6 is a front view of the first racket of the present invention.
Figure 7:
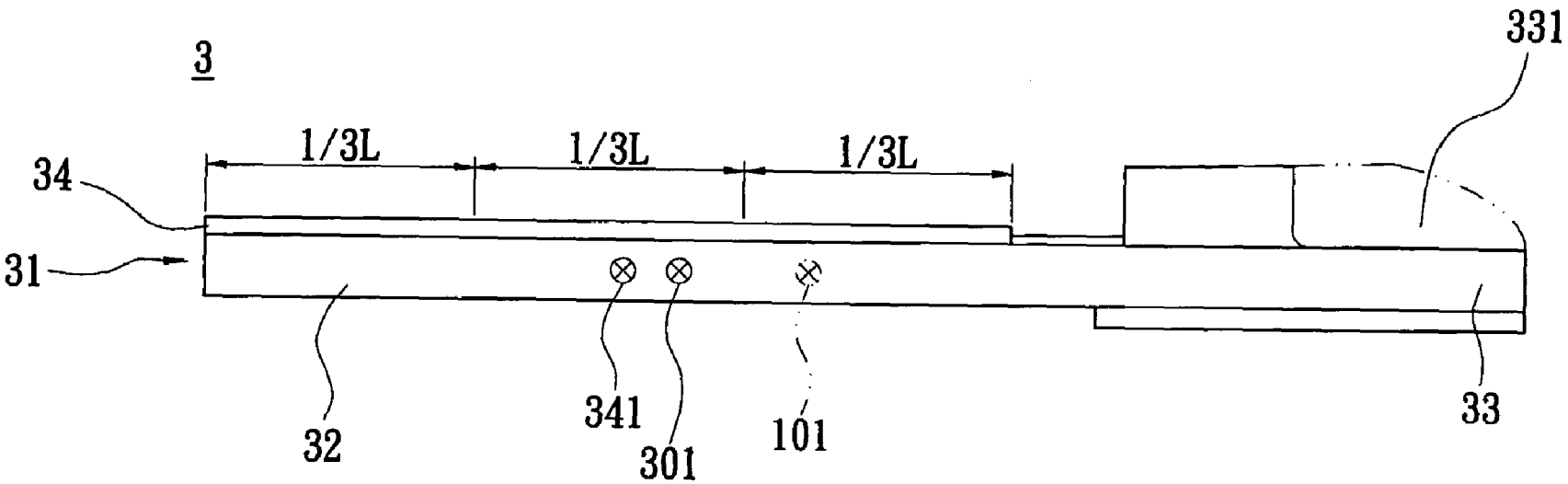
FIG. 7 is a side view of the first racket of the present invention in FIG. 6.
Figure 8:
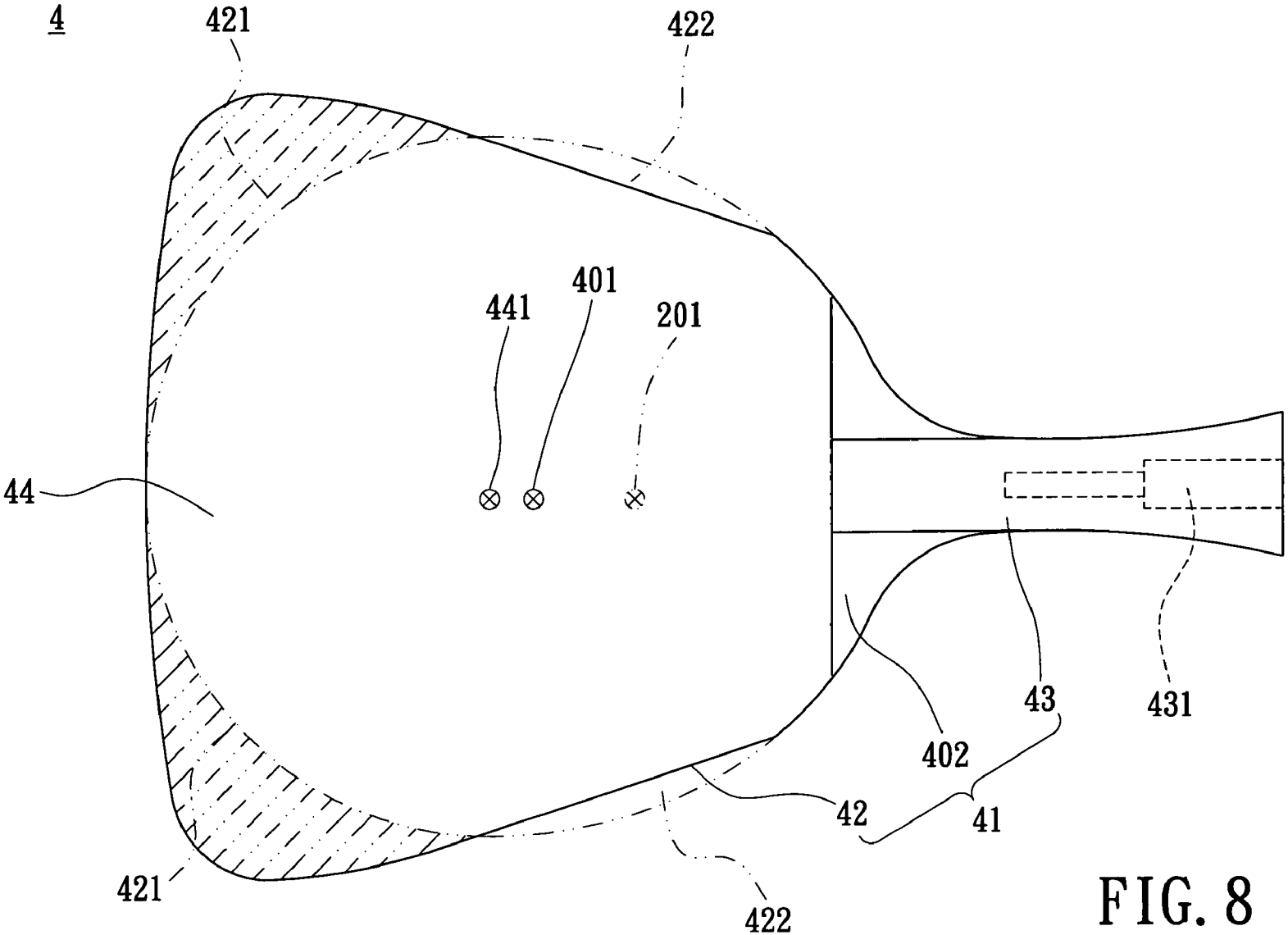
FIG. 8 is a front view of a second racket of the present invention comparing to the conventional circular racket.
Figure 9:
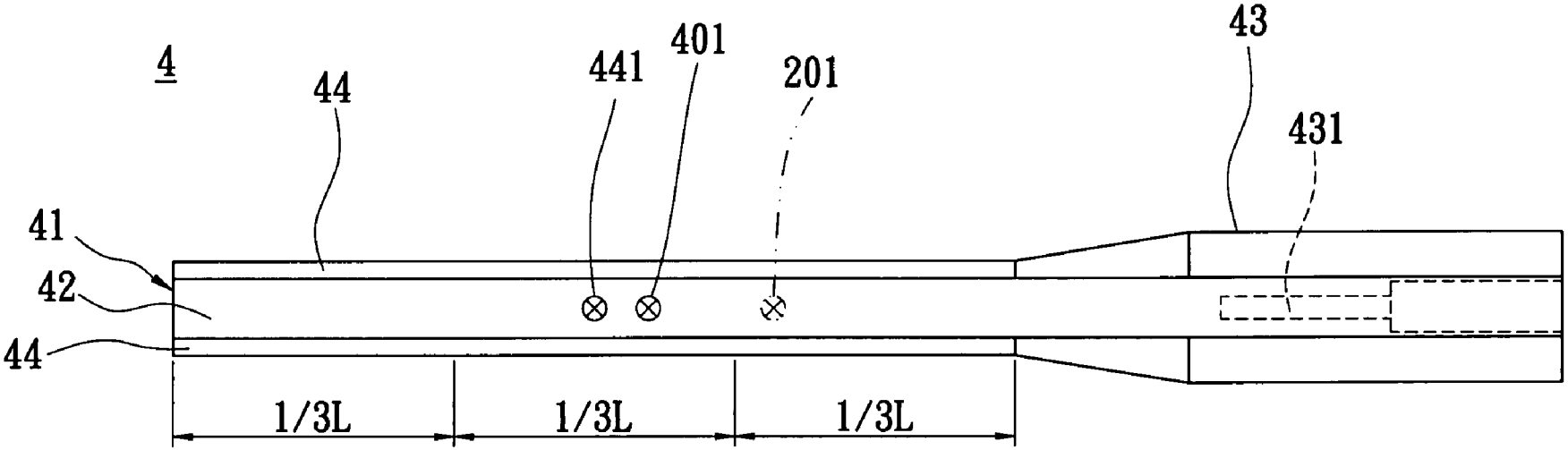
FIG. 9 is a side view of the second racket of the present invention.

Referring to FIGS. 5–9, a racket with a center of gravity approximate to a center of a rubber sheet of the present invention is provided. FIGS. 5–7 show a first racket 3 of the present invention that is an improvement upon the conventional square racket, and FIGS. 8–9 show a second racket 4 of the present invention that is an improvement upon the conventional circular racket.

Referring to FIGS. 6–8, each of rackets 3, 4 of the present invention comprises a blade 31, 41, and a rubber sheet 34, 44. The blades 31, 41 comprise a head 32, 42, a neck 302, 402, and a handle 33, 43, respectively. The rubber sheets 34, 44 are attached to the heads 32, 42. The necks 302, 402 are disposed between the heads 32, 42 and the handles 33, 43.

Referring to FIG. 5 and FIG. 8, in order to make centers of gravity 301, 401 of the rackets 3, 4 close to centers of rubber sheet 341, 441, portions 322, 422 disposed in corners of two sides of a rear end of the heads 32, 42 are removed, and two extending portions 321, 421 (the diagonal portion) disposed in corners of two sides of a front end of the heads 32, 42 are extended. Thus, the heads 32, 42 are substantially trapezoid-shaped. The front ends of the heads 32, 42 define an arched wide side, respectively (shown in FIG. 8). A line connecting outermost points of the arched wide sides or other shape of wide sides is disposed in a half potion of the heads 32, 42. The two arched wide sides gradually narrow from the two outermost points to the necks 302, 402 to define two sides of the heads 32, 42. A narrow side is formed in the rear ends of the heads 32, 42. Thus, the heads 32, 42 are trapezoid-shaped when seen from the wide sides to the narrow sides. The square racket is improved to a trapezoid-shaped racket or the circular racket is improved to a trapezoid-shaped racket, making the centers of gravity 301, 401 of the rackets 3, 4 close to the centers of rubber sheet 341, 441.

Additionally, if the handles 33, 43 or the rackets 3, 4 can be lightened, the object of the present invention is further achieved. FIG. 7 illustrates a handle 33 of the first racket 3 and FIGS. 8–9 illustrates a handle 43 of the second racket 4. The handle 43 is formed by removing part of a rear end of the handle 33 and a concave portion 331 is defined. A hole 431 is bored along an axial direction in the rear end of the handle 43, and the hole 431 maybe a single hole or a plurality of holes with different sizes. This can lighten the handles 33, 43 and make the centers of gravity 301, 401 even closer to the centers of rubber sheet 341, 441.

In other words, the centers of gravity 301, 401 of the rackets 3, 4 can be closer to the centers of rubber sheet 341, 441 compared to the centers of gravity 101, 201 of the conventional rackets by making the heads 32, 42 gradually narrower from front to back and lightening the handles 33, 43. Referring to FIG. 7 and FIG. 9, the heads 32, 42 (or the rubber sheets 34, 44) are divided into three equal portions (three L/3s). As can be seen from above, the centers of gravity 301, 401 of the rackets 3, 4 are positioned in the high ball-strike area of the middle, but the center of gravity 101 (201) is positioned beyond the area.

The racket with a center of gravity approximate to a center of a rubber sheet of the present invention has the following advantages: First, the centers of gravity 301, 401 are closer to the centers of rubber sheet 341, 441. Because the player will strike balls with the centers of rubber sheet 341, 441, areas adjacent of the centers of rubber sheet 341, 441 are in the high ball-strike area. In other words, the centers of gravity 301, 401 can be positioned in the high ball-strike area. Second, because the centers of gravity 301, 401 all move forwardly, the moment is increased. Third, because the centers of gravity 301, 401 are in the high ball-strike area (even when the moment is increased), high energy balls can be hit in areas adjacent the centers of gravity 301, 401. Balls are thus hit more aggressively, and making various games more fun and popular. Fourth, because the areas of the half front portion of the heads 32, 42 are increased, it is difficult to lose balls far from the player, which enhances the defense. Fifth, because the strike are close to the centers of gravity 301, 401, shock can be reduced. Sixth, because the front ends of the rackets 3, 4 are wide sides, wind fanned from the rackets 3, 4 is bigger than that of the conventional square racket and the circular racket, making them more useful for a player to disseminate heat. Seventh, because the rackets 3, 4 (blades 31, 41) are substantially triangular in shape, the rackets 3, 4 can in incised with little waste to satisfy environmental protection regulations.

As can be seen from the above, the racket with a center of gravity approximate to a center of a rubber sheet of the present invention can indeed solve the problems of the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extend indicated by the broad general meaning of the terms in which the appended claims are expressed.

What is claimed is:

1. A racket comprising:

a) a blade having:

i) a head having a first end having a width wider than a width of a second end;

ii) a handle; and iii) a neck located between the handle and the second end of the head; and b) a rubber sheet connected to the head, wherein, the head is divided into three thirds, each of the three thirds extending across a face thereof perpendicular to a length of the handle, the head and the rubber sheet each have a center of gravity located in a center third of the three thirds.

2. The racket according to claim 1, wherein the handle has a concave portion removed from an end thereof located opposite the neck.

3. The racket according to claim 1, wherein the handle has at least one hole.

4. The racket according to claim 3, wherein the at least one hole is bored in an axial direction.

5. The racket according to claim 3, wherein the at least one hole includes a plurality of holes having different sizes and bored in an axial direction.

6. The racket according to claim 1, wherein the head has a trapezoid shape.

7. The racket according to claim 1, wherein the head has a triangle shape.

* * * * *